US008893344B2

(12) United States Patent
Boucherie

(10) Patent No.: US 8,893,344 B2
(45) Date of Patent: Nov. 25, 2014

(54) BRUSH, IN PARTICULAR FOR HOUSEHOLD OR INDUSTRIAL APPLICATIONS

(75) Inventor: Bart Gerard Boucherie, Izegem (BE)

(73) Assignee: GB Boucherie NV, Izegem (BE)

( * ) Notice: Subject to any disclaimer, the term of this patent is extended or adjusted under 35 U.S.C. 154(b) by 788 days.

(21) Appl. No.: 12/935,610

(22) PCT Filed: Mar. 24, 2009

(86) PCT No.: PCT/EP2009/002148

§ 371 (c)(1),
(2), (4) Date: Sep. 30, 2010

(87) PCT Pub. No.: WO2009/121505

PCT Pub. Date: Oct. 8, 2009

(65) Prior Publication Data

US 2011/0041273 A1 Feb. 24, 2011

(30) Foreign Application Priority Data

Apr. 1, 2008 (DE) ..... 10 2008 016 637

(51) Int. Cl.

| | |
|---|---|
| ***A46B 3/00*** | (2006.01) |
| ***A46B 7/00*** | (2006.01) |
| ***A46B 3/06*** | (2006.01) |
| *A46D 3/00* | (2006.01) |

(52) U.S. Cl.

CPC ..... *A46B 3/06* (2013.01); *A46B 2200/302* (2013.01); *A46B 2200/3033* (2013.01); *A46D 3/005* (2013.01)

USPC ..... 15/171; 15/159.1; 15/191.1

(58) Field of Classification Search

USPC ..... 15/171, 191.1, 192, 193, 159.1

See application file for complete search history.

(56) References Cited

U.S. PATENT DOCUMENTS

| | | | | |
|---|---|---|---|---|
| 6,925,673 | B2 * | 8/2005 | Sartori | 15/191.1 |
| 6,957,468 | B2 * | 10/2005 | Driesen et al. | 15/167.1 |
| 7,284,295 | B2 * | 10/2007 | Brugora | 15/171 |

FOREIGN PATENT DOCUMENTS

| | | | |
|---|---|---|---|
| DE | 2840833 | A1 | 4/1980 |
| EP | 0 273 117 | * | 8/1990 |
| EP | 0736270 | A | 10/1996 |
| EP | 1 136 017 | * | 9/2001 |
| GB | 12221793 | A | 2/1971 |
| JP | 2004-254787 | * | 9/2004 |

OTHER PUBLICATIONS

International Search Report, (2009).
English translation of IPER and Written Opinion dated Oct. 14, 2010.

* cited by examiner

*Primary Examiner* — Randall Chin
(74) *Attorney, Agent, or Firm* — Carlson, Gaskey & Olds, PC

(57) ABSTRACT

A brush, in particular for household or industrial applications, has a bristle carrier plate made of plastic, a multitude of bristle bundles, which are attached in the bristle carrier plate, and at least one reinforcement plate, which is likewise made of plastic and is attached to the bristle carrier plate.

54 Claims, 5 Drawing Sheets

BRUSH, IN PARTICULAR FOR HOUSEHOLD OR INDUSTRIAL APPLICATIONS

RELATED APPLICATION

This application is the United States national phase of PCT/EP2009/002148, filed Mar. 24, 2009, which claims priority to DE 10 2008 016 637.5, filed Apr. 1, 2008.

FIELD OF THE INVENTION

The present invention relates to a brush, in particular for household or industrial applications. "Brush" is used here as a generic term for brushes, brooms and similar articles that are provided with bristles and used in households or in industry.

BACKGROUND

In the case of brushes it is known to fasten bristle bundles in a brush body by using a separate fastening method, for example stitching them in using a thread or fixing them in place with a metal cramp. This is relatively involved.

In the production of toothbrushes it is known to fasten the bristle bundles to the body of the toothbrush by directly insert molding them. For various reasons, this technique could so far only be applied with very short bristles and very small brush bodies.

There is a need to provide a brush which can be produced involving little effort.

SUMMARY

A brush, in particular for household or industrial applications, includes a bristle carrier plate made of plastic, a multitude of bristle bundles, which are attached in the bristle carrier plate, and at least one reinforcement plate, which is likewise made of plastic and is attached to the bristle carrier plate. This is based on the fundamental concept of producing the brush body in two parts, namely from the bristle carrier plate, which has the bristle bundles anchored thereto, and a reinforcement plate. This allows both the reinforcement plate and the bristle carrier plate to be produced with a low thickness while nonetheless a high stiffness is attained.

In one example, the bristle bundles consist of a multitude of bristles welded to each other at the end. This ensures that the bristles of a bristle bundle are firmly connected with each other, preventing individual bristles from falling out.

In one example, provision is made that the bristle bundles are welded to the bristle carrier plate. This ensures that each bristle bundle is reliably fastened to the brush.

According to one example of a preferred embodiment, provision is made that the bristle carrier plate is provided with at least one upstand. By using an upstand, a considerable increase in stability may be achieved while materials usage is low. The upstand may be located on only one side of the bristle carrier plate or else on both sides.

Provision may also be made that the upstand extends along the bristle carrier plate so as to continuously surround it. This allows the reinforcement plate to be received within the upstand.

The use of the bristle carrier plate and of the reinforcement plate makes it possible to be able to design the brush with a very small thickness in comparison with its dimensions. In particular, it is possible that a ratio of the length of the bristle carrier plate to the thickness of the bristle carrier plate and of the reinforcement plate within the upstand is greater than 10, preferably greater than 20. In this way, a brush body is obtained which can be produced using a very small amount of materials.

The bristle carrier plate preferably has a thickness of between 3 and 7 mm. At the same time it may have a length of between 5 and 50 cm and a width of between 3 and 10 cm. Further, it may be provided for that the ratio of the thickness of the reinforcement plate to the thickness of the reinforcement plate and of the bristle carrier plate is smaller than 0.6.

BRIEF DESCRIPTION OF THE DRAWINGS

The invention is described below with reference to various embodiments, which are illustrated in the accompanying drawings, in which.

DETAILED DESCRIPTION

Figure 1:
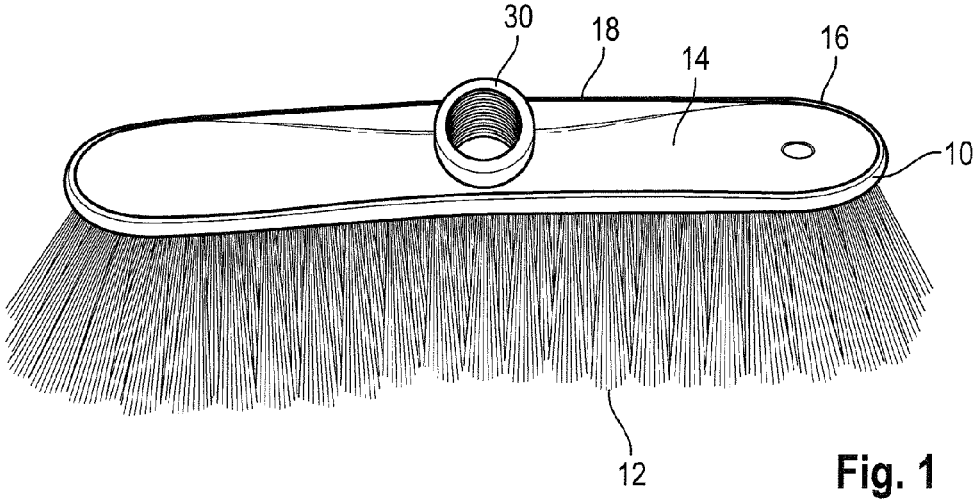
FIG. 1 shows a perspective view of a broom.
Figure 2:
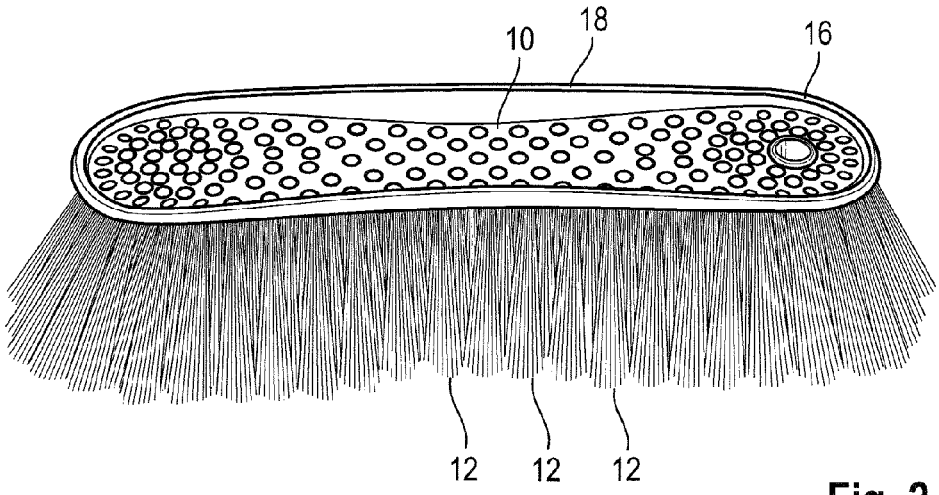
FIG. 2 shows a perspective view of the bristle carrier plate provided with bristle bundles, for the broom of FIG. 1.

FIGS. 1 to 4 show a brush according to a first embodiment. It is made up of a bristle carrier plate 10, a multitude of bristle bundles 12, and a reinforcement plate 14.

The bristle carrier plate 10 has a generally oblong shape, the length/width ratio being on the order of 1:6. The thickness D of the bristle carrier plate 10 amounts to between 3 and 7 mm. It is provided with a continuously surrounding upstand 16 which, for the most part, has a height of from 3 to 5 mm and, in a region 18, has a height of just under 20 mm.

The bristle carrier plate 10 is provided with a multitude of receiving openings 20, which are provided with a shoulder 22 on the inside, on which the reinforcement plate 14 is arranged later. On the opposite side, i.e. the outside, the receiving openings are provided with an oblique widening portion 24. The bristle carrier plate 10 is preferably made from a thermoplastic material, for example polypropylene. An opening 26 is provided at one end of the bristle carrier plate; the broom can be hung up later using the opening.

Figure 4:
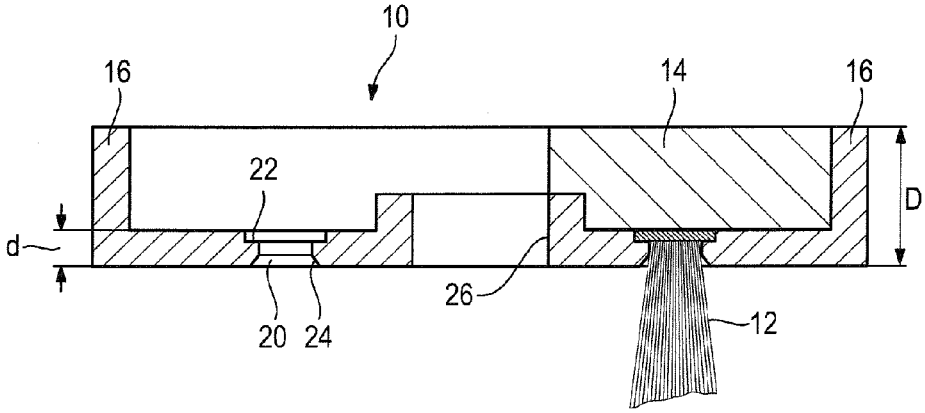
FIG. 4 shows a section taken along the plane IV-IV of FIG. 3, on an enlarged scale.

Each of the bristle bundles 12 is inserted in one of the receiving openings 20 of the bristle carrier plate 10, with each bristle bundle being made up of a multitude of individual bristles which are welded to each other at one end of the bristle bundle. This is schematically shown in FIG. 4 for the receiving opening on the right-hand side. When loading the bristle carrier plate, the respective bristle bundle is fitted into the receiving opening 20, which is facilitated by the widening portion 24. The bristle bundle is then fused at its end lying within the reinforcement plate and, at the same time, is firmly connected with the bristle carrier plate. The connection is preferably achieved by a combination of welding and mechanically connecting. For one thing, the material of the bristle carrier plate is surface-fused to a small extent when the ends of the bristle bundles 12 are welded, so that an inter-material joint is produced. For another thing, the soft, welded end of each bristle bundle is pressed into the bristle carrier plate in such a way that a mechanical connection materializes there under the action of heat. In this way, each bristle bundle 12 is reliably fastened within the bristle carrier plate 10.

The material used for the bristles may be the same as that used for the bristle carrier plate, for example polypropylene. But bristles made from a different material may also be used, or bristle bundles may be used which consist of a mixture of different bristles, for example partly of a thermoplastic material such as PET, PP, PA, or polyester, and partly of natural fibers, for example natural hairs or vegetable fibers. Depending on the desired type of connection of the bristle bundles 12 with the bristle carrier plate 10, it may be provided that the melting temperature of the material of the bristles differs from the melting temperature of the material of the bristle carrier plate.

Figure 3:
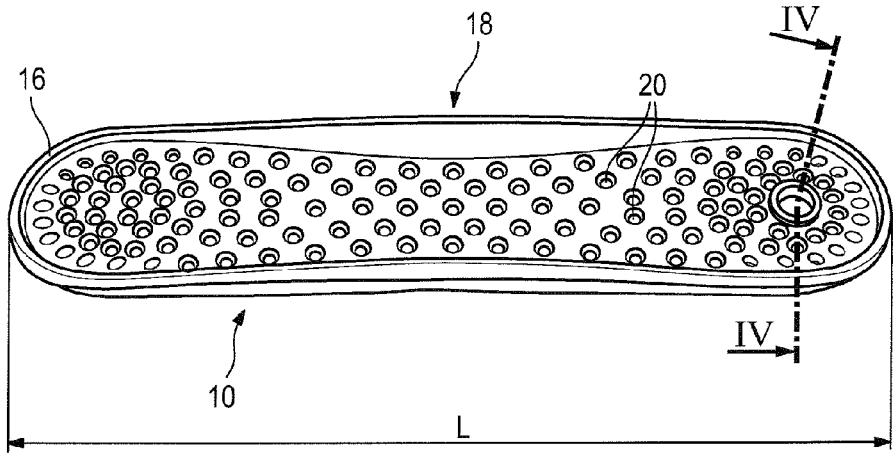
FIG. 3 shows a perspective view of the bristle carrier plate for the broom of FIG. 1.

As can be seen in FIG. 3 based on the distribution of the receiving openings 20, the bristle bundles are not evenly distributed over the surface of the bristle carrier plate 10. At the outer ends, the bristle carrier plate is more densely bristled than in the middle.

Arranged on the inside of the bristle carrier plate 10, i.e. on the side facing away from the free ends of the bristle bundles 12, is the reinforcement plate 14. The latter is injection molded on the inside of the bristle carrier plate 10 within the upstand 16 here, so that the reinforcement plate 14 terminates flush with the upstand 16 (see the right-hand side in FIG. 4). Provided adjacent to the raised region 18 of the upstand 16 is a mount 30 for a broomstick, in this case a threaded bushing.

The connection of the bristle carrier plate 10 provided with the upstand 16 to the reinforcement plate 14 results in a broom having a body which, while having a very small thickness, exhibits a very high stiffness. The thickness D is in the range of from 5 to 15 mm, with the ratio of the thickness of the reinforcement plate 14 to the thickness D of the reinforcement plate and the bristle carrier plate being smaller than 0.6. Considering that the broom has a length L on the order of, for example, 25 cm, the very small thickness D is well visible. In particular, the ratio of the length L of the bristle carrier plate to the thickness D of the bristle carrier plate and the reinforcement plate within the upstand amounts to more than 10, preferably more than 20. As related to the length of the bristle field in the bristle carrier plate, this ratio amounts to more than 9.

The reinforcement plate 14 may either consist of the same material as the bristle carrier plate 10, for example of polypropylene, or of a different material, for example a thermosetting material such as epoxy resin. Preferably, the reinforcement plate consists of a material having a greater hardness than the material of the bristle carrier plate. In this way, a high strength is achieved. Moreover, the loads occurring can be taken into account in this manner, which are greatest at the transition between the threaded bushing 30 and the body of the reinforcement plate 14. In addition, provision may be made that the reinforcement plate and the bristle carrier plate are of different colors.

Figure 5:
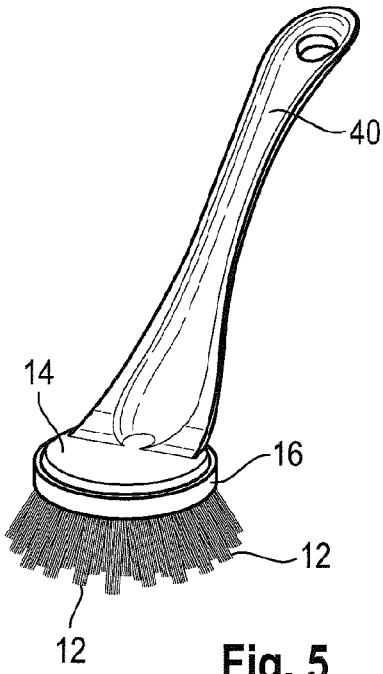
FIG. 5 shows a perspective view of a household brush.
Figure 6:
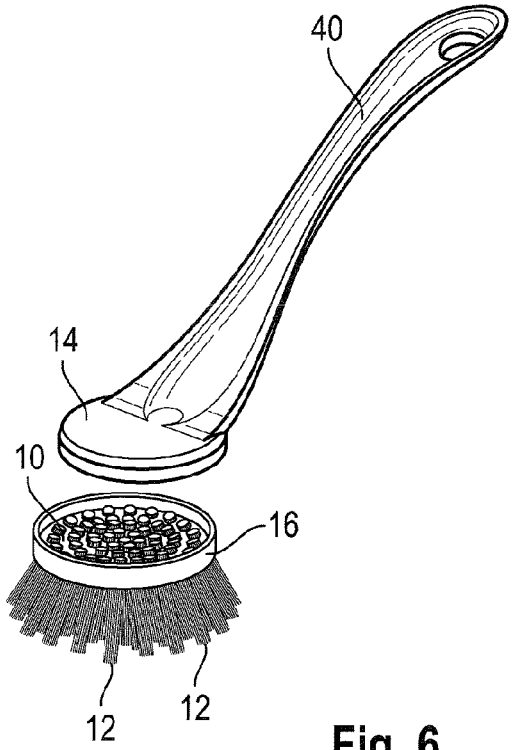
FIG. 6 shows the reinforcement plate and the bristle carrier plate of the brush of FIG. 5 in a condition separate from each other, in a perspective view.
Figure 7:
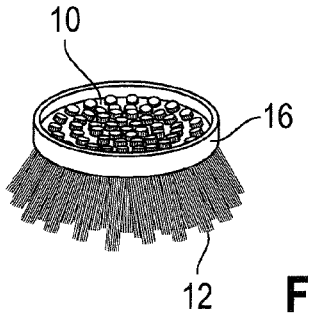
FIG. 7 shows the bristle carrier plate, provided with bristle bundles, of the brush of FIG. 5 in a perspective view.

FIGS. 5 to 7 show a brush, for example a dishwashing brush. The essential difference from the first embodiment resides in the shape of the bristle carrier plate 10, which is of a round and slightly spherical configuration here, the concavity being located on the side of the welded ends of the bristle bundles 12. A handle 40 is integrally molded with the reinforcement plate 14.

The upstand 16 is made to have an unvarying height and to be continuously surrounding here, and the upstand surrounds reinforcement plate completely while the reinforcement plate projects upwards beyond the upstand. The reinforcement plate 14 may be welded with the bristle carrier plate 10. Alternatively, provision may be made that the reinforcement plate 14 snaps into place inside the upstand 16, for example in that one of the two parts is provided with a groove and the other with a surrounding bead. It would further be possible to adhesively join the reinforcement plate 14 to the bristle carrier plate 10.

Also in the case of the brush shown, a very high ratio of the length (or rather, the diameter) of the bristle carrier plate 10 and the thickness of the bristle carrier plate and of the reinforcement plate is used in order to attain a high stability while employing a small amount of materials.

Depending on the requirements, it may be provided for that the thickness of the bristle carrier plate 10 is not constant throughout, but varies. In particular, the thickness of the bristle carrier plate may be reduced toward the edge.

Figure 8:
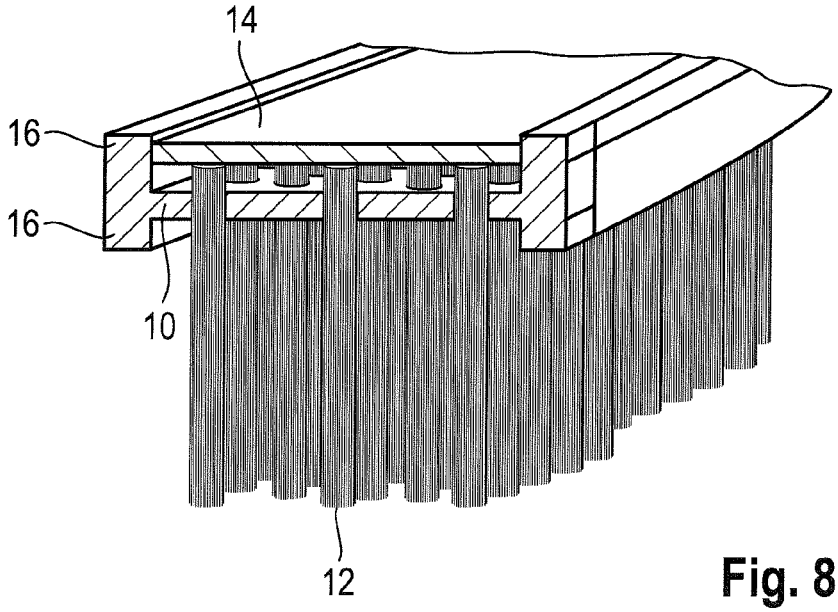
FIG. 8 shows a brush in a schematic sectional view.

FIG. 8 shows a further embodiment, which differs from the two preceding embodiments essentially in that the upstand 16 is now formed on both sides of the bristle carrier plate 10, i.e. both on the side of the reinforcement plate 14 and on the side of the free ends of the bristle bundles 12. This results in a particularly high stiffness of the bristle carrier plate 10, similar to a carrier having an I-section.

Deviating from the very schematic illustration in FIG. 8, the space between the carrier plate 10 and the reinforcement plate 14 is not hollow, but filled with a mixture of melted bristles and the plastic material of the reinforcement plate 14.

Figure 9:
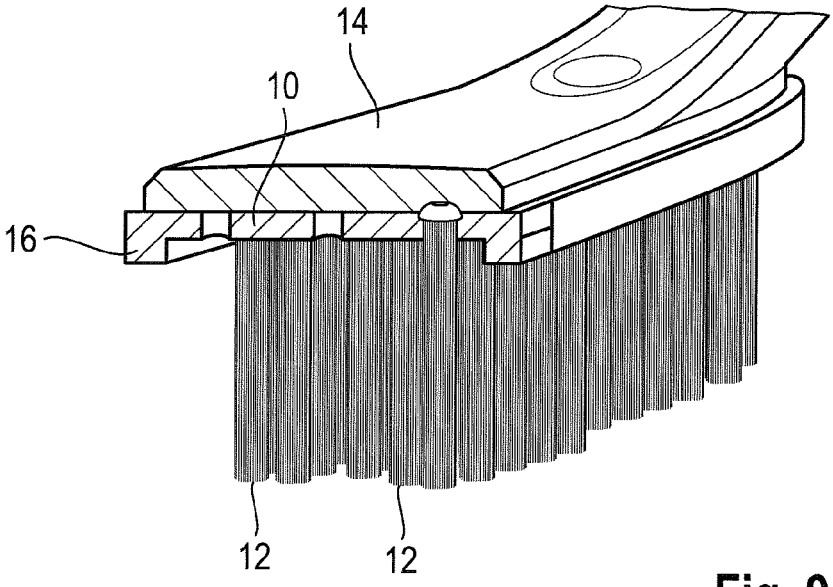
FIG. 9 shows a perspective sectional view of a brush according to a further embodiment.

FIG. 9 shows a further embodiment, which differs from the preceding embodiments in that the upstand 16 is only arranged on the side of the bristle carrier plate 10 facing the free ends of the bristle bundles 12. Arranged on the rear side of the bristle carrier plate 10 is the reinforcement plate 14 which covers the fused ends (well visible here) of the bristle bundles 12. In this embodiment, too, the reinforcement plate 14 is arranged within the outline of the bristle carrier plate 10.

Figure 10:
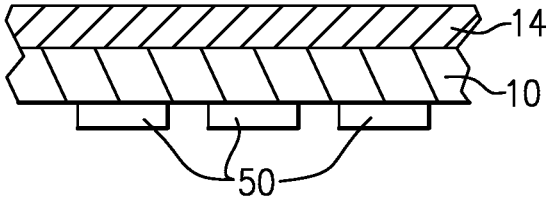
FIG. 10 shows one example of rubber elements attached to at least one of the reinforcement plate or bristle carrier plate.
Figure 11:
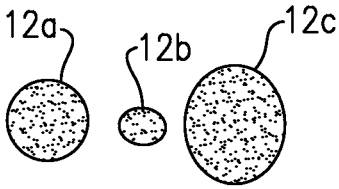
FIG. 11 shows one example of bristle bundles having different sizes.
Figure 12:
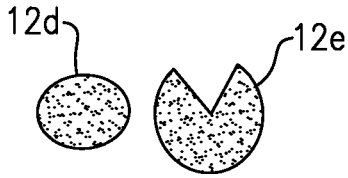
FIG. 12 shows one example of bristle bundles having different shapes.

According to a further development, rubber elements 50 (FIG. 10) having a cleaning or wiping effect or else having a shock protection effect may be attached to the reinforcement plate 14 and/or to the bristle carrier plate 10. Furthermore, provision may be made that the bristle bundles 12 received in a bristle carrier plate 10 have different sizes 12*a*, 12*b*, 12*c* (FIG. 11) or different shapes 12*d*, 12*e* (FIG. 12), e.g. cut in a stepped shape, in a V-section, etc. Also, premachined bristle bundles may be made use of (e.g., having pointed bristle ends, slit bristle ends or pre-rounded bristle ends).

Figure 13:
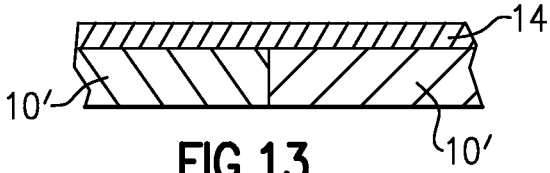
FIG. 13 shows one example of a plurality of bristle carrier plates being attached to a reinforcement plate in a parallel arrangement.
Figure 14:
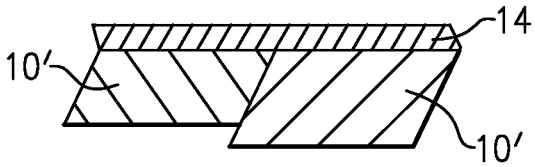
FIG. 14 shows one example of a plurality of bristle carrier plates being attached to a reinforcement plate in an inclined arrangement.

According to a further development, it may be provided for that, rather than one single, continuous bristle carrier plate, a plurality of bristle carrier plates 10' (FIG. 13) is attached to the reinforcement plate 14. This leads to a higher flexibility. As a result, it is also possible to use bristles of very different types, involving little expense, by inserting different bristle carrier plates which are each loaded with one and the same type of bristles. The bristle carrier plates may be arranged parallel to one another or else inclined (FIG. 14) in relation to one another in order to obtain a profiling.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A brush, in particular for household or industrial applications, comprising:

a bristle carrier plate made of plastic, wherein the bristle carrier plate is provided with at least one upstand;

a multitude of bristle bundles attached in the bristle carrier plate; and at least one reinforcement plate made of plastic and attached to the bristle carrier plate, and wherein the at least one reinforcement plate is substantially parallel to the bristle carrier plate, and wherein the reinforcement plate is comprised of the same material as the bristle carrier plate or of a material that has a greater hardness than a material of the bristle carrier plate.

2. The brush according to claim 1, wherein each bristle bundle comprises a multitude of bristles welded to each other at one end.

3. The brush according to claim 2, wherein the bristle bundles are each mechanically connected with the bristle carrier plate on a side facing the reinforcement plate by mixing melted plastic of the bristles and of the bristle carrier plate.

4. The brush according to claim 3, wherein a melting temperature of a material of the bristles differs from a melting temperature of a material of the bristle carrier plate.

5. The brush according to claim 2, wherein the bristles are comprised of the same material as the bristle carrier plate.

6. The brush according to claim 2, wherein the bristles are comprised of a different material from that of the bristle carrier plate.

7. The brush according to claim 2, wherein the bristles are comprised at least in part of a thermoplastic material or polyester.

8. The brush according to claim 2, wherein the bristles are comprised of a mixture of natural fibers and fibers made from a thermoplastic material.

9. The brush according to claim 2, wherein at least one rubber element having a shock protection effect is attached to at least one of the bristle carrier plate and reinforcement plate.

10. The brush according to claim 1, wherein the bristle bundles are welded to the bristle carrier plate.

11. The brush according to claim 1, wherein the bristle bundles are welded to each other at ends facing the reinforcement plate.

12. The brush according to claim 1, wherein the bristle carrier plate is comprised of a thermoplastic material.

13. The brush according to claim 1, wherein the reinforcement plate has a different color than the bristle carrier plate.

14. The brush according to claim 1, wherein the reinforcement plate is comprised of a thermoplastic material.

15. The brush according to claim 1, wherein the reinforcement plate is comprised of a thermosetting material.

16. The brush according to claim 1, wherein the upstand is made integrally with the bristle carrier plate to be continuously surrounding the reinforcement plate.

17. The brush according to claim 16, wherein the continuously surrounding upstand extends on a side facing away from the bristle bundles.

18. The brush according to claim 16, wherein a continuously surrounding upstand extends on a side facing the bristle bundles.

19. The brush according to claim 1, wherein the bristle carrier plate includes a receiving opening for each bristle bundle, and wherein the reinforcement plate is located within the upstand to cover the receiving openings.

20. The brush according to claim 19, wherein the reinforcement plate terminates flush with the upstand.

21. The brush according to claim 1, wherein the reinforcement plate protrudes beyond the at least one upstand.

22. The brush according to claim 1, wherein the at least one upstand includes a raised section and wherein the reinforcement plate is provided with a mount for a stick in a region of the raised section of the at least one upstand.

23. The brush according to claim 1, wherein a thickness of the bristle carrier plate and that of the reinforcement plate together within the at least one upstand is in a range of 5 to 15 mm.

24. The brush according to claim 1, wherein a height of the at least one upstand is on an order of 3 to 20 mm.

25. The brush according to claim 1, wherein a ratio of a length of a bristle field in the bristle carrier plate to a thickness of the bristle carrier plate and of the reinforcement plate together within the at least one upstand is greater than 9.

26. The brush according to claim 1, wherein the reinforcement plate is located within an outline of the bristle carrier plate.

27. The brush according to claim 1, wherein the reinforcement plate is injection-molded onto the bristle carrier plate.

28. The brush according to claim 1, wherein the reinforcement plate is subsequently fitted to the bristle carrier plate by at least one of bonding, welding, or snapping into place.

29. The brush according to claim 1, wherein the bristle carrier plate has a thickness of between 3 and 7 mm.

30. The brush according to claim 1, wherein the bristle carrier plate has a length of between 5 and 50 cm and a width of between 3 and 10 cm.

31. The brush according to claim 1, wherein a ratio of a thickness of the reinforcement plate to a thickness of the reinforcement plate and the bristle carrier plate together is smaller than 0.6.

32. The brush according to claim 1, wherein at least one rubber element having a cleaning or wiping effect is attached to at least one of the bristle carrier plate and reinforcement plate.

33. The brush according to claim 1, wherein the bristle bundles have different sizes.

34. The brush according to claim 1, wherein the bristle bundles have different shapes.

35. The brush according to claim 1, wherein a thickness of the bristle carrier plate varies by decreasing towards an edge.

36. The brush according to claim 1, wherein a thickness of the bristle carrier plate is the same throughout a bristled area of the bristle carrier plate.

37. The brush according to claim 1, wherein the reinforcement plate has a plurality of bristle carrier plates attached thereto.

38. The brush according to claim 37, wherein the bristle carrier plates are parallel to each other.

39. The brush according to claim 37, wherein the bristle carrier plates are inclined in relation to each other.

40. The brush according to claim 1, wherein the upstand is formed as part of the bristle carrier plate.

41. The brush according to claim 40, wherein the bristle carrier plate comprises a plate body and wherein the upstand is formed with the plate body to extend outwardly about an outer periphery of the plate body.

42. The brush according to claim 1, wherein the reinforcement plate has a front side that faces the bristle carrier plate and a rear side that faces opposite the front side, and wherein the rear side includes a mount configured to receive a handle that is obliquely orientated relative to the reinforcement plate.

43. A brush, in particular for household or industrial applications, comprising:

a bristle carrier plate made of plastic, wherein the bristle carrier plate is provided with at least one upstand;

a multitude of bristle bundles attached in the bristle carrier plate; and at least one reinforcement plate made of plastic and attached to the bristle carrier plate, and wherein the at least one reinforcement plate is substantially parallel to the bristle carrier plate, and wherein the reinforcement plate is comprised of a material which has a greater hardness than a material of the bristle carrier plate.

44. A brush, in particular for household or industrial applications, comprising:

a bristle carrier plate made of plastic;

a multitude of bristle bundles attached in the bristle carrier plate; and at least one reinforcement plate made of plastic and attached to the bristle carrier plate, wherein the at least one reinforcement plate is substantially parallel to the bristle carrier plate, and wherein for each bristle bundle the bristle carrier plate has a separate receiving opening which is widened on a side facing away from the reinforcement plate, and wherein the reinforcement plate is comprised of the same material as the bristle carrier plate or of a material that has a greater hardness than a material of the bristle carrier plate.

45. The brush according to claim 44, wherein at least some of the receiving openings are provided with a shoulder on a respective side facing the reinforcement plate that receives a welded end of the bristle bundle.

46. The brush according to claim 44, wherein the reinforcement plate is attached to the bristle carrier plate to cover the receiving openings.

47. The brush according to claim 44, wherein the reinforcement plate has a front side that faces the bristle carrier plate and a rear side that faces opposite the front side, and wherein the rear side includes a mount configured to receive a handle that is obliquely orientated relative to the reinforcement plate.

48. A brush, in particular for household or industrial applications, comprising;

a bristle carrier plate made of plastic. wherein the bristle carrier plate is provided with at least one upstand;

a multitude of bristle bundles attached in the bristle carrier plate; and at least one reinforcement plate made of plastic and attached to the bristle carrier plate, and wherein the at least one reinforcement plate is substantially parallel to the bristle carrier plate, and wherein a ratio of a length of the bristle carrier plate to a thickness of the bristle carrier plate and of the reinforcement plate within the at least one upstand is greater than 10.

49. A brush, in particular for household or industrial applications, comprising:

a bristle carrier plate made of plastic;

a multitude of bristle bundles attached in the bristle carrier plate;

at least one reinforcement plate made of plastic and attached to the bristle carrier plate, wherein the bristle carrier plate, the at least one reinforcement plate, and the bristle bundles are configured to form a household or industrial cleaning brush;

wherein for each bristle bundle the bristle carrier plate has a separate receiving opening which is widened on a side facing away from the reinforcement plate; and wherein the reinforcement plate is comprised of the same material as the bristle carrier plate or of a material that has a greater hardness than a material of the bristle carrier plate.

50. The brush according to claim 49, wherein the household or industrial cleaning brush comprises a dishwashing brush.

51. The brush according to claim 49, wherein the reinforcement plate has a front side that faces the bristle carrier plate and a rear side that faces opposite the front side, and wherein the rear side includes a mount configured to receive a handle that is obliquely orientated relative to the reinforcement plate.

52. The brush according to claim 49, wherein the reinforcement plate is attached to the bristle carrier plate to cover the receiving openings.

53. The brush according to claim 49, wherein the bristle carrier plate is provided with at least one upstand, and wherein a ratio of a length of the bristle carrier plate to a thickness of the bristle carrier plate and of the reinforcement plate within the at least one upstand is greater than 10.

54. The brush according to claim 49, wherein the material that comprises the reinforcement plate has a greater hardness than the material of the bristle carrier plate.

* * * * *